US005378877A

United States Patent [19]

Lee

[11] Patent Number: 5,378,877

[45] Date of Patent: Jan. 3, 1995

[54] METHOD AND APPARATUS FOR PERFORMING PROGRAMMED COOKING WITH AN AUTOMATIC DELAY START FEATURE IN MICROWAVE OVENS

[75] Inventor: Chang W. Lee, Seoul, Rep. of Korea

[73] Assignee: Goldstar Co., Ltd., Rep. of Korea

[21] Appl. No.: 965,315

[22] Filed: Oct. 23, 1992

Related U.S. Application Data

[63] Continuation-in-part of Ser. No. 785,372, Oct. 30, 1991, abandoned.

[30] Foreign Application Priority Data

Oct. 31, 1990 [KR] Rep. of Korea ..... 90-17510

[51] Int. Cl.[6] ..... H05B 6/68

[52] U.S. Cl. ..... 219/719; 219/720; 219/721; 219/723

[58] Field of Search ..... 219/10.55 C, 10.55 B, 219/10.55 D, 10.55 M, 10.55 R, 719, 720, 721, 722, 723, 716, 737

[56] References Cited

U.S. PATENT DOCUMENTS

| | | | |
|---|---|---|---|
| 4,295,027 | 10/1981 | Zushi et al. | 219/10.55 B |
| 4,309,585 | 1/1982 | Doi et al. | 219/10.55 B |
| 4,345,135 | 8/1982 | Harmon | 219/10.55 B |
| 4,378,487 | 3/1983 | Maeda | 219/10.55 C |
| 4,517,431 | 5/1985 | Ueda | 219/10.55 B |
| 4,533,810 | 8/1985 | Harmon et al. | 219/10.55 B |
| 4,613,739 | 9/1986 | Richards | 219/10.55 B |
| 4,785,152 | 11/1988 | Hirata et al. . | |
| 4,833,284 | 5/1989 | Park . | |

*Primary Examiner*—Philip H. Leung
*Attorney, Agent, or Firm*—Morgan & Finnegan

[57] ABSTRACT

The present invention provides a method and system for performing a delay start regardless of the open/-close state of the microwave oven door, where the present time Tp is continually counted after a warning signal telling a user to close the door is produced, even if the door is opened during the pre-cooking start time stage or the door is opened during the post-cooking time stage, whereby further cooking is interrupted after the warning signal is produced until the door is closed. Therefore, cooking can be started at a pre-determined time even if the door is opened during the execution of the delay start.

4 Claims, 3 Drawing Sheets

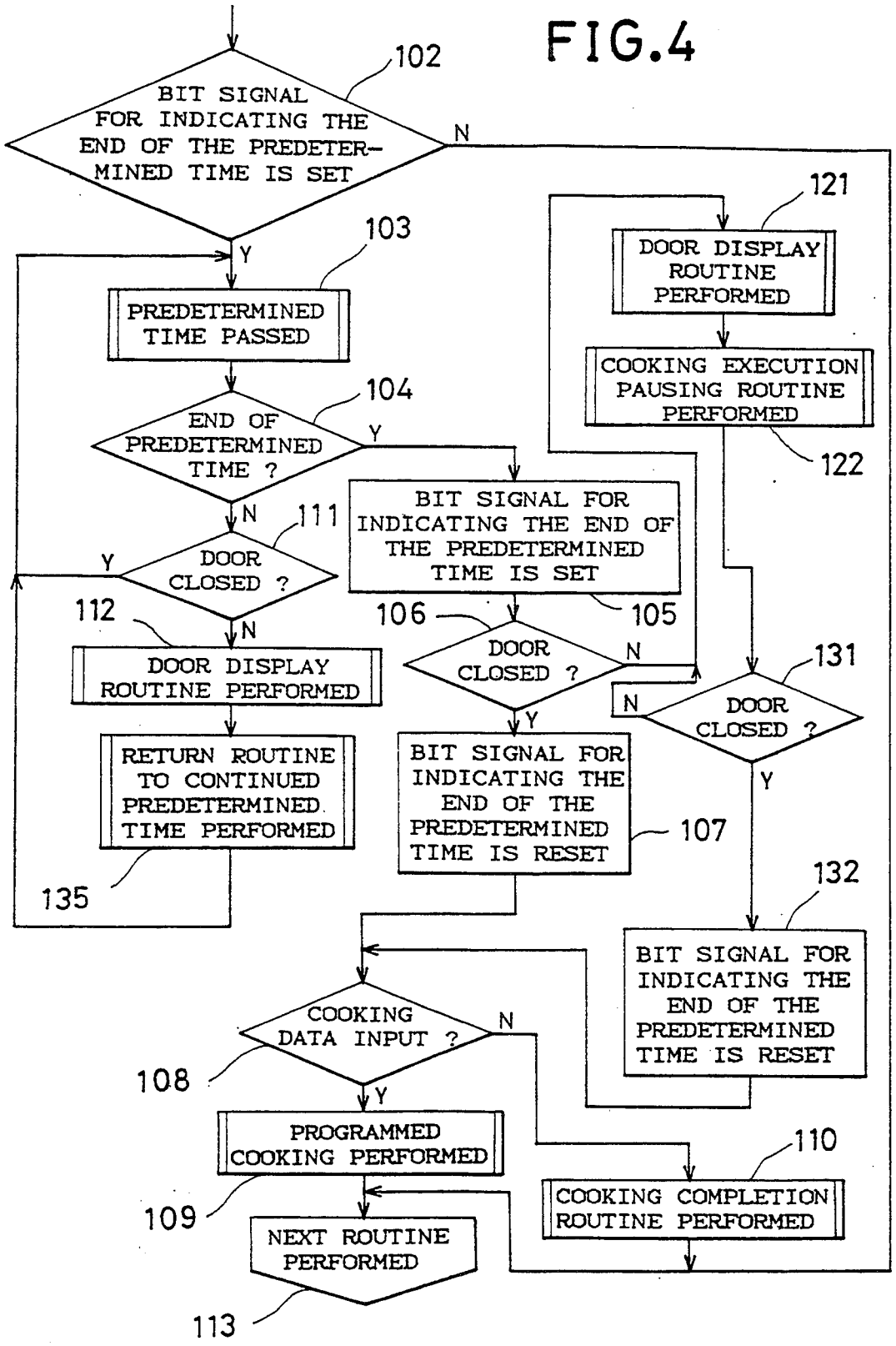
FIG.4
102
BIT SIGNAL FOR INDICATING THE END OF THE PREDETERMINED TIME IS SET
N
Y
103
PREDETERMINED TIME PASSED
104
END OF PREDETERMINED TIME ?
Y
N
111
DOOR CLOSED ?
Y
N
112
DOOR DISPLAY ROUTINE PERFORMED
RETURN ROUTINE TO CONTINUED PREDETERMINED TIME PERFORMED
135
BIT SIGNAL FOR INDICATING THE END OF THE PREDETERMINED TIME IS SET
105
106
DOOR CLOSED ?
N
Y
BIT SIGNAL FOR INDICATING THE END OF THE PREDETERMINED TIME IS RESET
107
121
DOOR DISPLAY ROUTINE PERFORMED
COOKING EXECUTION PAUSING ROUTINE PERFORMED
122
131
DOOR CLOSED ?
N
Y
132
BIT SIGNAL FOR INDICATING THE END OF THE PREDETERMINED TIME IS RESET
COOKING DATA INPUT ?
N
108
Y
PROGRAMMED COOKING PERFORMED
109
NEXT ROUTINE PERFORMED
113
110
COOKING COMPLETION ROUTINE PERFORMED

METHOD AND APPARATUS FOR PERFORMING PROGRAMMED COOKING WITH AN AUTOMATIC DELAY START FEATURE IN MICROWAVE OVENS

This application is a continuation-in-part of application Ser. No. 07/785,372, filed on Oct. 31, 1991, now abandoned and incorporated herein by reference.

FIELD OF THE INVENTION

The present invention concerns a microwave oven, and more particularly a system and process for performing a delay start, regardless of the open/close state of the microwave oven door.

BACKGROUND OF THE INVENTION

Today a microwave oven user sometimes wants a microwave oven having a so-called delay start function. This function allows a microwave oven to start cooking a food that is in the oven a certain time after a start key is pressed.

However, in conventional microwave ovens, the delay start function pauses when a user opens a door of the microwave oven to check the food. To re-start the delay start function of the prior art, the user has to close the door and re-press a start key.

Therefore, if the user opens the door to check the food and closes the door, but unconsciously fails to re-press the start key, the delay start function does not work.

Consequently, the food remains uncooked because cooking did not start.

SUMMARY OF THE INVENTION

To solve the above described problems, the present invention provides a system and process for keeping track of the counting time until the present time (Tp) ,comes to the cooking start time (Ts) regardless of the open/close start of the microwave oven door. Furthermore, the present invention provides a warning, such as a set of LED displays and a buzzer, for notifying the user that the door has to be closed.

According to one aspect of the present invention, a method for performing a delay start of a microwave oven comprises:

1. a pre-cooking start time stage comprising the steps of:
   a) counting the present time Tp, regardless of the open/close start of the microwave oven door;
   b) checking if the present time Tp has come to the cooking start time Ts;
   c) sensing the open/close state of the microwave oven door if the present time Tp has not yet come to the cooking start time Ts;
   d) returning to step a) if the door is closed in the step c);
   e) warning the user that the microwave oven door is open and has to be closed, if the door is open in step c); and
   f) returning to step a) to keep counting the present time;
2. a post-cooking start time stage, that occurs after the present time Tp comes to the cooking start time Ts in step b), comprising the steps of:
   g) sensing the open/close state of the microwave oven door;

h) warning the user that the door of the microwave oven is open and has to be closed, if the door is open in step g); and
   i) returning to step g) to keep sensing the open/close state of the microwave oven door;

said steps g), h), and i) of the post-cooking time stage continue until the door of the microwave oven is closed; and
3. a cooking stage, which happens only when the door of the microwave oven is closed in step g).

The above method is performed in a microwave oven that comprises a key input means, a key input analysis means for analyzing the information input by the key input means, a memory means for storing the cooking data obtained from analyzing the information, a means for executing the delay start, a clock means for timing the delay start, a door switch sensing means for sensing the open/close state of the microwave oven door, and a display device for warning the user when the door is open.

The present invention will now be described with reference to the attached drawings, which are merely exemplary of the described invention, and therefore non-limiting.

BRIEF DESCRIPTION OF THE DRAWING

FIG. 4 is a flow chart illustrating the steps for performing the delay start in the present invention.

DETAILED DESCRIPTION OF THE INVENTION

The invention will now be described with reference to FIGS. 1–4 where like elements are numbered the same.

Figure 1:
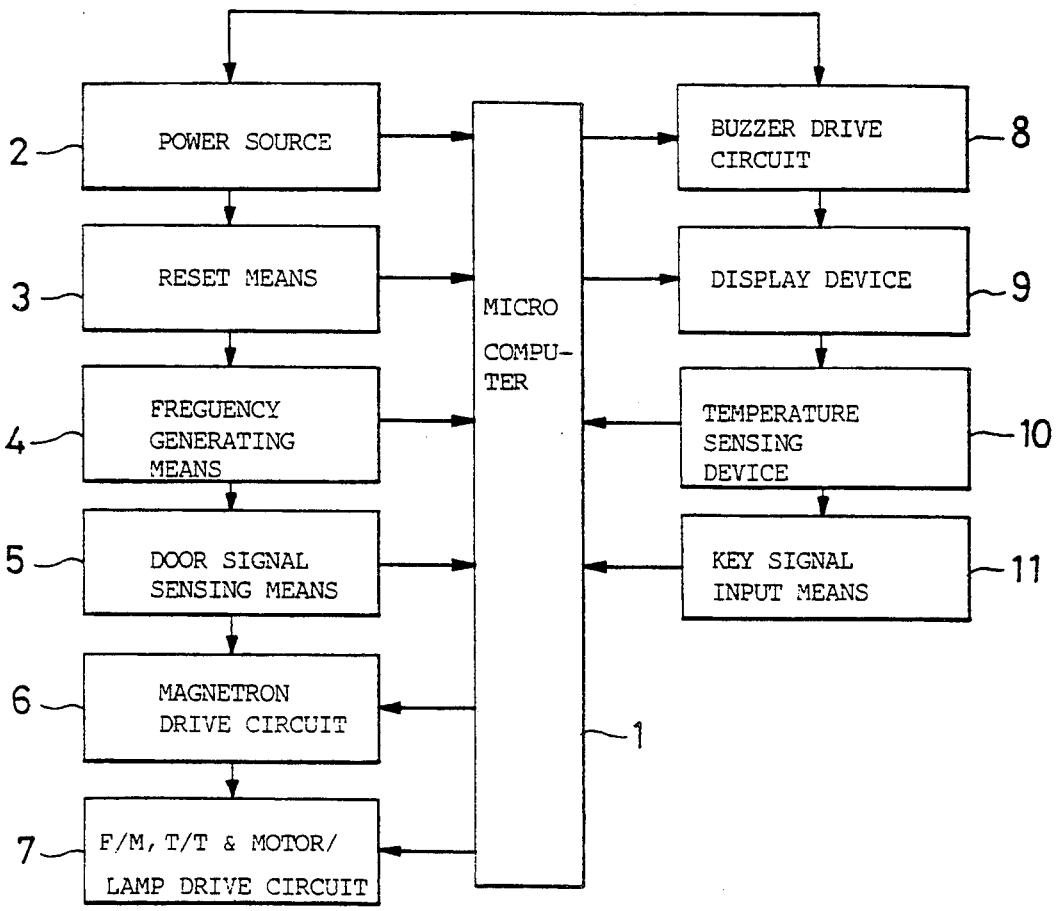
FIG. 1 is an overall block diagram illustrating the operational flow of the circuit off a microwave oven of the present invention.

Referring to FIG. 1, the circuit of a microwave oven of the present invention comprises a power source 2, reset means 3, frequency generating means 4, door state sensing means 5, and key input means 11, which constitute an external input circuit.

A microcomputer 1 is driven by an external input circuit and has an internal program designed to perform a delay start.

The microcomputer 1 controls a magnetron drive circuit 6, motor/lamp drive circuit 7, buzzer drive circuit 8, and a display device 9.

The buzzer and display device are examples of warning means. When the door of the present invention is open, the buzzer makes a warning sound telling the user to close the door, and the display device displays a set of warning characters.

Figure 2:
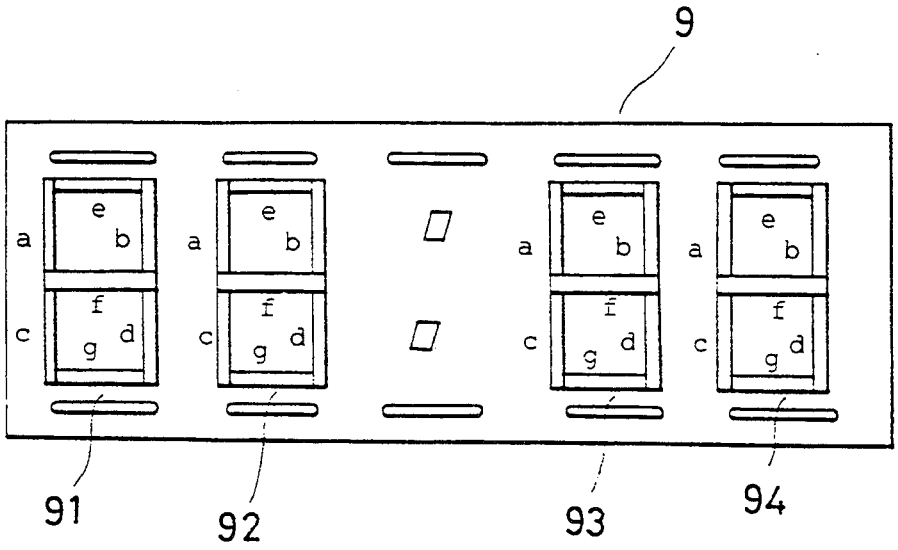
FIG. 2 schematically shows an example of warning means for warning a user that the microwave oven door is open and has to be closed.

Referring to FIG. 2, the display device 9 includes first, second, third, and fourth display parts 91–94, which indicate a pre-determined cooking time or the present time Tp. Each segment a–g of the display part 91–94 contains a plurality of LEDs. The display device 9 also displays warning characters for telling the user to close the door during the execution of the delay start function.

The delay start function system of a microwave oven according to the present invention comprises a key input means 11, a key input analysis means 12 for analyzing the information input by the key input means, a memory means (e.g., a storage device) 14 for storing the cooking data obtained from analyzing the inputted information, a cooking program execution means 15 controlling all functions of a microwave oven including a delay start function, a clock means 13 for timing the pre-set cooking program including the delay start, a door switch sensing means 16 for sensing the open/close state of the microwave oven door, and a display means 7 and 9 for warning the user when the door is open.

Figure 3:
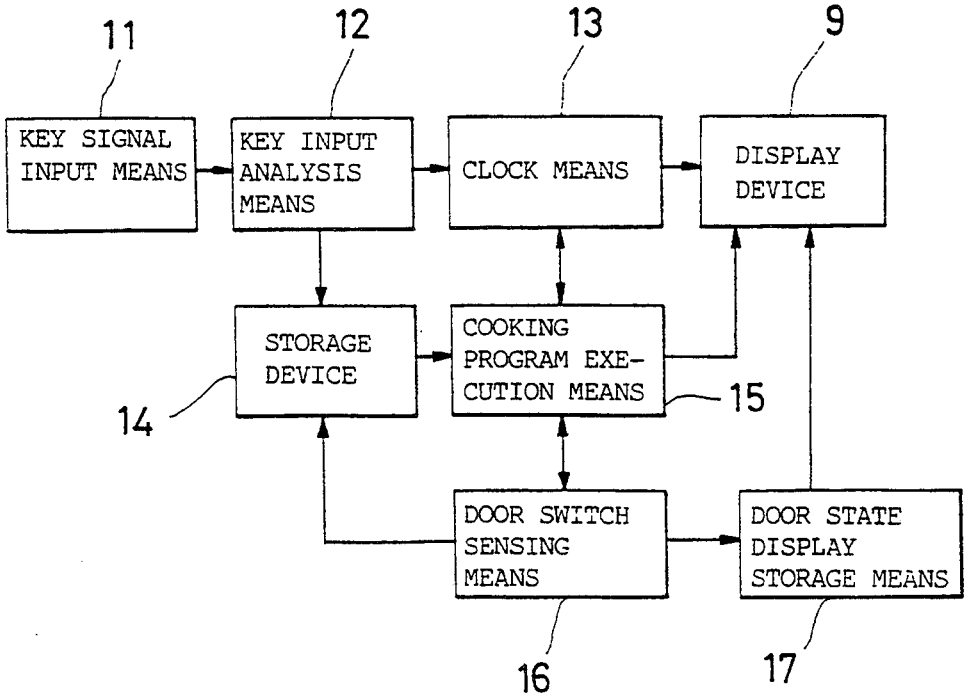
FIG. 3 is a block diagram schematically illustrating the circuit particularly for performing a delay start in the present invention.

The frequency generating means of FIG. 1 and the clock means of FIG. 3 are similar in that they both generate clock signals. However, the frequency generating means of FIG. 1 is for general operation of the microcomputer and clock means of FIG. 3 is for a cooking program including the delay start.

To execute a delay start, a user selects from the key input means 11 a delay start key and other keys in accordance with the food to be cooked. The key inputs are analyzed at a key input analysis means 12 into such data as cooking start time, cooking condition, etc. The data for a delay start and cooking procedures are stored in a memory means 14.

The delay start of the microwave oven is executed according to the flow chart depicted in FIG. 4.

At first, a check is made to see if a delay start execution bit has been set [102]. If the bit has not been set, a stand-by step [113] is executed. If the bit has been set, however, a present time counting step [103] is executed through a delay start execution means (15), a clock means (13), and memory means (14).

The next step is to check if the present time Tp has come to the cooking start time Ts [104]. If the present time Tp has come to the cooking start time Ts at step [104], a post-cooking start time stage is executed.

If the present time Tp has not yet come to the cooking start time Ts at step [104], a door state sensing step [111] is executed to check if the door is closed.

If the door is closed, the present time counting step [103]is executed to continue counting the present time.

If the door is open, however, a warning step [112] is executed to warn the user that the door has to be closed, and the present time counting step [103] is executed to continue counting the present time, regardless of the open/close state of the microwave oven door.

At this point the pre-cooking start time stage ends.

To sum up, the present time is continually counted after a warning, even if the door is open during the pre-cooking start time stage.

When the present time is at the cooking start time Ts at step [104], a delay start end bit is set [105].

Then, the door state sensing step is executed [106].

If the door is open, a warning step [121] and a cooking execution routine pausing step [122] are executed sequentially, and the door state sensing step [[31] is executed again.

The cooking execution pausing step [122] is not essential to the present invention, but it serves as a double safety control step.

The steps [121], [122], and [106] are repeatedly executed until the door is closed. As a result, the cooking stage is interrupted until the door is closed.

When the door is finally closed, however, the delay start end bit is reset to complete a post-cooking start time stage.

To sum up, further cooking execution is interrupted while a warning that the door is open is given during the post-cooking start stage.

Finally, while in a cooking stage [108], a check is made to see if the cooking data are stored in the memory means (14). If the cooking data are stored in the memory means (14), the cooking execution routine [109] and a cooking completion routine [110]are carried out sequentially.

If the cooking data are not stored in the memory means (14), however, a cooking completion routine is executed [110], whereby the cooking execution routine is omitted.

Therefore, cooking can be started at a pre-determined time even if the door is opened during the execution of the delay start.

consequently, the cooking can be finished on time, only if the door is closed as soon as a user notices the door is opened from the warning means.

Although the invention has been described in conjunction with a specific embodiment, it is evident that many alternatives and variations will be apparent to those skilled in the art in light of the foregoing description. Accordingly, the invention is intended to embrace all of the alternatives and variations that fall within the spirit and scope of the appended claims.

What is claimed:

1. A method of performing a delay start in a microwave oven having a door, comprising the steps of:

(A1) determining whether a delay start execution has been requested by a user to delay a cooking operation in the microwave oven for a delay period;

(A2) delaying execution of the cooking operation in the microwave oven by the delay period by continuously counting down the delay period without interruption when said determining step (A1) determines that the user has requested the delay start execution;

(A3) determining whether the delay period has expired;

(A4) determining whether the door of the microwave oven is open when said determining step (A3) determines that the delay period has not expired;

(A5) performing an open door warning routine when said determining step (A4) determines that the door is open; and (A6) returning to said determining step (A3) without resetting the delay period, and executing the delay start irrespective of whether the door is one of open and closed, wherein when said determining step (A3) determines that the delay period has expired, said method further comprises the steps of:

(B1) determining whether the door of the microwave oven is open;

(B2) resetting the delay period when said determining step (B1) determines that the door is closed;

(B3) in response to resetting the delay period in step (B2), determining whether cooking data is stored in a memory; and (B4) in response to determining in step (B3) that cooking data is stored in the memory, performing the cooking operation as defined by the cooking data, wherein when said determining step (B1) determines that the door is open, said method further comprises the steps of (C1) performing an open door warning routine;

(C2) performing a cooking operation pausing routine;

(C3) determining whether the door of the microwave oven is open; and (C4) returning to said performing step (C1) when said determining step (C3) determines that the door is open, and wherein when said determining step (C3) determines that the door is closed, said method further comprises the steps of (D1) resetting the delay period;

(D2) in response to resetting the delay period in step (D1), determining whether cooking data is stored in the memory; and (D3) in response to determining in step (D2) that cooking data is stored in the memory, performing the cooking operation as defined by the cooking data.

2. The method of claim 1 wherein step (A2) is a pre-cooking start time stage including the steps of:

counting a present time Tp, regardless of an open/-close state of the microwave oven door; and determining when the present time Tp has reached a cooking start time Ts and thus ending the delay period.

3. An apparatus for performing a delay start in a microwave oven having a door, comprising:

(A1) means for determining whether a delay start execution has been requested by a user to delay a cooking operation in the microwave oven for a delay period;

(A2) means for delaying execution of the cooking operation in the microwave oven by the delay period by continuously counting down the delay period without interruption when said determining means (A1) determines that the user has requested the delay start execution;

(A3) means for determining whether the delay period has expired;

(A4) means for determining whether the door of the microwave oven is open when said determining means (A3) determines that the delay period has not expired;

(A5) means for performing an open door warning routine when said determining means (A4) determines that the door is open;

(A6) returning means for indicating to said determining means (A3) to continue performing the determining without resetting the delay period; and (A7) means for executing the delay start irrespective of whether the door is one of open and closed;

(A8) means for determining whether the door of the microwave oven is open when said determining means (A3) determines that the delay period has expired;

(A9) means for resetting the delay period when said determining means (A8) determines that the door is closed;

(A10) means for determining whether cooking data is stored in a memory when said resetting means (A9) resets the delay period;

(All) means for performing the cooking operation when said determining means (A10) determines that the cooking data is stored in the memory;

(A12) means for performing an open door warning routine when said determining means (A8) determines that the door is open;

(A13) means for performing a cooking operation pausing routine when said performing means (A12) performs the open door warning routine;

(A14) means for determining whether the door of the microwave oven is open when said performing means (A13) performs the cooking operation pausing routine;

(A15) means for indicating to said performing means (A12) to continue executing the performing when said determining means (A14) determines that the door is open;

(A16) means for resetting the delay period when said determining means (A14) determines that the door is closed, (A17) means for resetting the delay period when said resetting means (A16) performs said resetting;

(A18) means for determining whether cooking data is stored in the memory when said resetting means (A17) performs said resetting; and (A19) means for performing the cooking operation when said determining means (A18) determines that the cooking data is stored in the memory.

4. The apparatus of claim 3, wherein the warning means of (A5) and (A12) is a LED display device.

* * * * *